United States Patent [19]

Crudele

[11] Patent Number: 4,462,484

[45] Date of Patent: Jul. 31, 1984

[54] TENSION SENSING DEVICE

[75] Inventor: Richard E. Crudele, Farmington Hills, Mich.

[73] Assignee: Platforms and Power, Inc., Livonia, Mich.

[21] Appl. No.: 298,947

[22] Filed: Sep. 3, 1981

[51] Int. Cl.[3] ..... E04G 3/10

[52] U.S. Cl. ..... 182/19; 182/112; 182/142

[58] Field of Search ..... 182/19, 112, 142–147, 182/150; 188/65.1–65.5; 187/22

[56] References Cited

U.S. PATENT DOCUMENTS

| | | | |
|---|---|---|---|
| 1,126,260 | 1/1915 | Neenan et al. | 187/22 |
| 2,435,969 | 2/1948 | Lackner | 182/112 |
| 2,560,499 | 7/1951 | Warry | 187/22 |
| 2,939,550 | 6/1960 | Puttre | 182/112 |
| 3,586,125 | 6/1971 | Durand | 182/112 |
| 3,661,226 | 5/1972 | Fisher | 182/142 |
| 3,671,712 | 6/1972 | Fisher | 182/142 |
| 3,797,608 | 3/1974 | Virdis | 182/142 |
| 3,908,801 | 9/1975 | Pohlman | 182/112 |
| 4,106,753 | 8/1978 | Cavalieri et al. | 254/384 |
| 4,225,012 | 9/1980 | Hindle | 182/112 |
| 4,237,999 | 12/1980 | Batreau | 182/19 |

*Primary Examiner*—Reinaldo P. Machado
*Attorney, Agent, or Firm*—Harness, Dickey & Pierce

[57] ABSTRACT

A tension sensing device for scaffolds suspended by at least one hoist cable is described. The tension sensing device generally comprises a support structure adapted to be secured to the scaffold and having guide means for directing the hoist cable through the device, lever arm means for sensing the tension on the hoist cable, and switch means for detecting a slack cable or a strained cable condition. The support structure includes a cover plate assembly with at least one section of the cover plate assembly constructed from a transparent material so that the tension on the hoist cable may also be visually observed.

13 Claims, 3 Drawing Figures

TENSION SENSING DEVICE

BACKGROUND AND SUMMARY OF THE INVENTION

The present invention relates generally to safety devices for movable platforms, and particularly to tension sensing devices for scaffolds suspended by one or more hoist cables.

During the normal operation of a suspended scaffold, two undesirable and dangerous conditions can typically occur. The first is where the support or hoist cable is overtensioned, thereby placing an abnormal strain on the cable and increasing the probability of the cable breaking or fracturing. This strained cable condition can occur when the combined weight of the scaffold, equipment and operators exceed the rating of the cable. The strained cable condition can also arise when the upward movement of the scaffold is resisted by a fixed projection engaging a portion of the scaffold structure. The second dangerous condition is where the hoist cable is under tensioned, thereby creating an abnormal under-tension condition or lack of support from the cable and subjecting the scaffold to tipping and the drive mechanisms to misalignment. In both of these dangerous conditions, a possibility of overloading the obstruction could cause damage, or fracture and falling objects. This under-tensioned cable condition can occur when the downward movement of the scaffold is resisted by a fixed projection engaging a portion of the scaffold structure.

Prior techniques for determining the strained cable condition have typically been based upon sensing the displacement of the hoist cable relative to the scaffold structure. Since a load must be imparted to the scaffold structure in order for these prior arrangements to indicate an increase in the strain on the hoist cable, they are not capable of detecting an abnormal strain due to other types of restraining forces. For example, a force could restrain the hoist mechanism from climbing the hoist cable or restrain a mooring cable without affecting the load on the scaffold structure. Accordingly, these prior arrangements can be dangerously inaccurate and give a false sense of security to the scaffold operators.

Accordingly, it is a principal object of the present invention to provide a novel tension sensing device capable of accurately and reliably detecting both under-tensioned and strained cable conditions on the hoist cable of a suspended scaffold.

It is an additional object of the present invention to provide a tension sensing device which is capable of giving a visual indication of the tension on the hoist cable.

It is a further object of the present invention to provide a tension sensing device which is simple and rugged in construction, yet flexible in design for use in a variety of scaffold sizes and types.

It is yet another object of the present invention to provide a tension sensing device wherein the controls are grouped together at one central location so as to provide for convenient observation and the like.

It is still a further object of the present invention to provide a tension sensing device which may be provided with means for measuring the degree or angle of unlevelness of the associated scaffold structure, i.e., the present invention lends itself to being provided with instrumentation for sensing the degree of scaffold levelness.

In accordance with the foregoing objects, the present invention provides a tension sensing device generally comprising a support structure adapted to be secured to the scaffold and having guide means for directing the hoist cable through the device, lever arm means for sensing the tension on the hoist cable, and switch means for detecting the under and over-tensioned cable conditions in response to the movement of the lever arm means. The lever arm means includes a generally vertically disposed lever arm member pivotally mounted to the support structure for pivotal movement in response to a variation in the tension of the hoist cable, a sheave rotatably mounted to the lever arm member, and spring means for biasing the sheave into engagement with the hoist cable. The switch means includes a first limit switch for detecting the under-tensioned cable condition in response to a first predetermined pivotal movement of the lever arm member, and a second limit switch for detecting the over-tensioned cable condition in response to a second predetermined pivotal movement of the lower arm member in the opposite direction of the first predetermined pivotal movement. The support structure also includes a cover plate assembly with at least one section of the cover plate assembly constructed from a transparent material so that the tension on the hoist cable may also be visually observed.

Additional advantages and features of the present invention will become apparent from a reading of the detailed description of the preferred embodiments which makes reference to the following set of drawings in which:

DETAILED DESCRIPTION OF THE PREFERRED EMBODIMENTS

Figure 1:
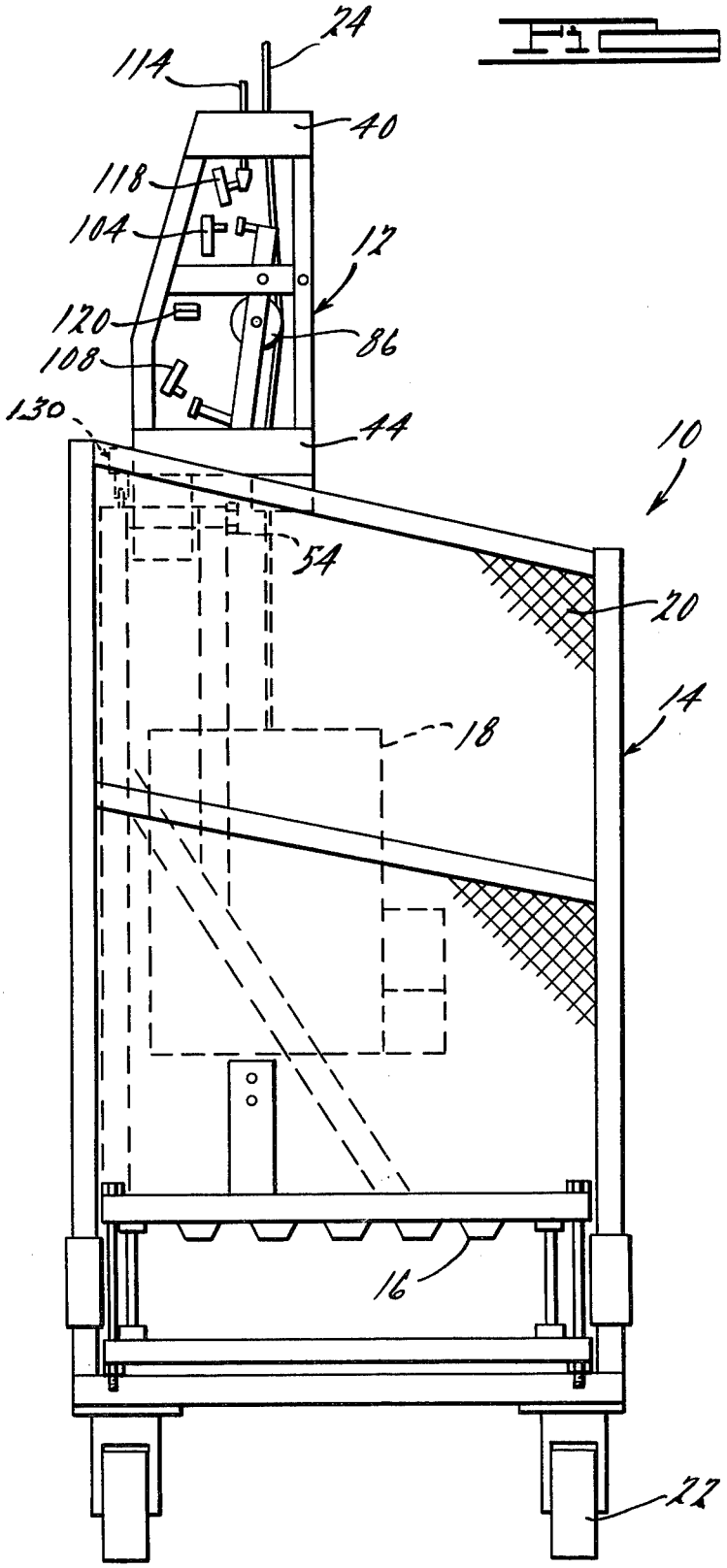
FIG. 1 is a side elevation view of a scaffold structure embodying a tension sensing device according to the present invention.

Referring to FIG. 1, a side elevation view of a scaffold structure 10 is shown which employs a tension sensing device 12 according to the present invention at each end thereof. The scaffold structure 10 generally comprises a framework 14, a platform formed from a plurality of elongated horizontally disposed support members 16 and a motorized hoist or winch mechanism 18 disposed at each end. The scaffold structure 10 also includes a plurality of protective grate-type side walls 20, and a set of wheels 22 for facilitating the movement of the scaffold structure on the ground. The scaffold structure 10 is adapted to be suspended along the vertical face of a building or the like by a hoist cable 24 disposed at each end of the scaffold structure. The motorized hoist mechanisms 18 are used to raise and lower the scaffold structure 10 by climbing and descending the hoist cables 24. It should be understood that the scaffold structure above described is intended to be exemplary only, and that the tension sensing device 12 may be employed with a variety of scaffold sizes and types. As will be more fully appreciated from the description below, the tension sensing device 12 according to the present invention may be used with traction-type hoist mechanisms where the hoist cable frictionally engages a sheave, or with drum-type hoist mechanisms where the hoist cable is wound around a suitable drum. Additionally, the tension sensing mechanism 12 may be used in scaffolding systems where the hoist mechanisms are located remotely from the scaffold structure, such as on the top of a building, or where the hoist mechanisms are part of the scaffold structure, such as shown in FIG. 1.

Figure 2:
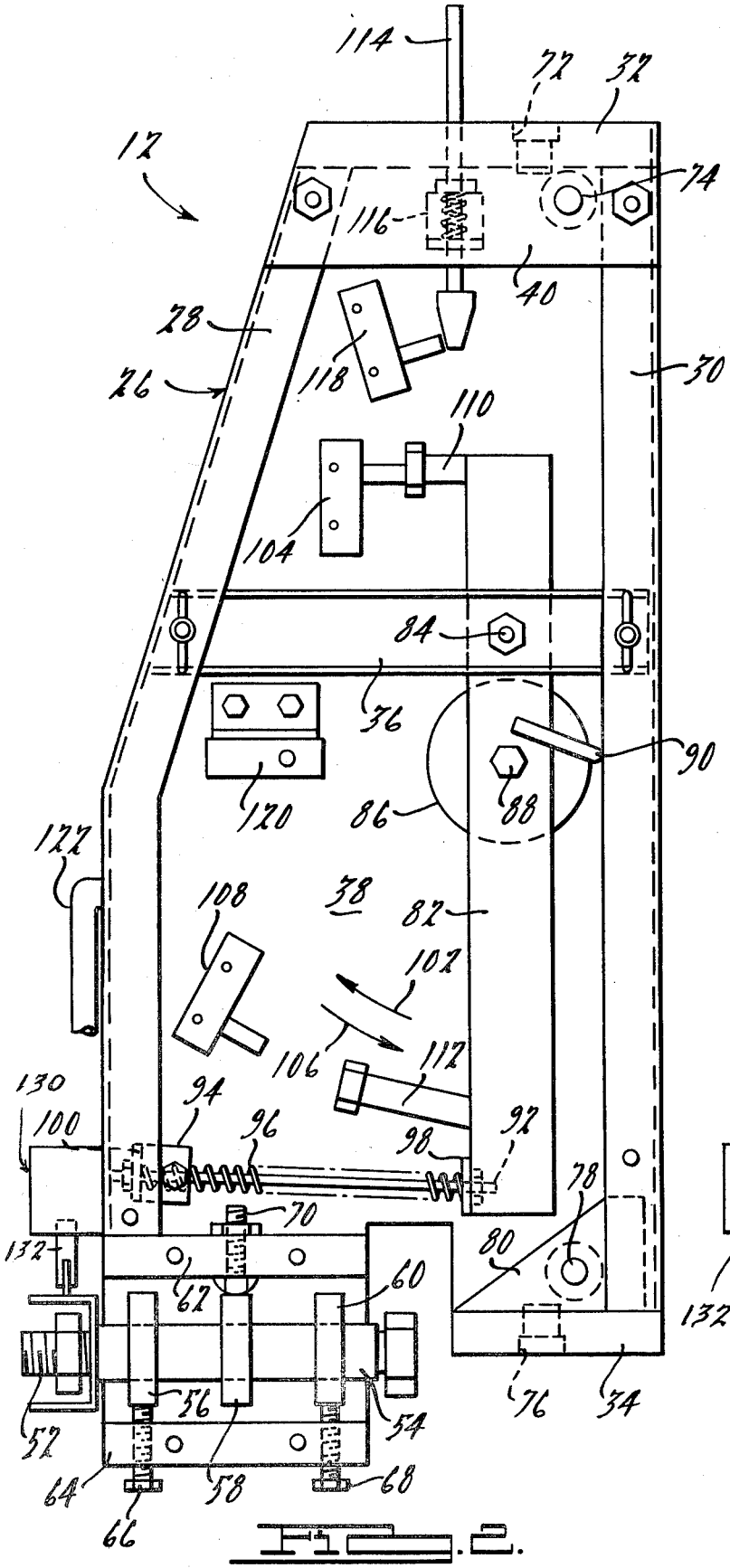
FIG. 2 is an enlarged front elevation view of the tension sensing device shown in FIG. 1.

Referring to FIG. 2, an enlarged front elevation view of the tension sensing device 12 is shown. The tension sensing device 12 includes a support structure 26 which is adapted to be adjustably secured to the scaffold structure 10. The support structure 26 generally comprises a pair of channel-shaped leg members 28 and 30, an upper bar member 32 welded or otherwise secured to the top of the leg members at each end, a lower bar member 34 secured to the bottom of the leg member 30 at one end, and a channel-shaped brace member 36 fastened or otherwise secured at one end to the leg member 28 and secured at the other end to the leg member 30.

Figure 3:
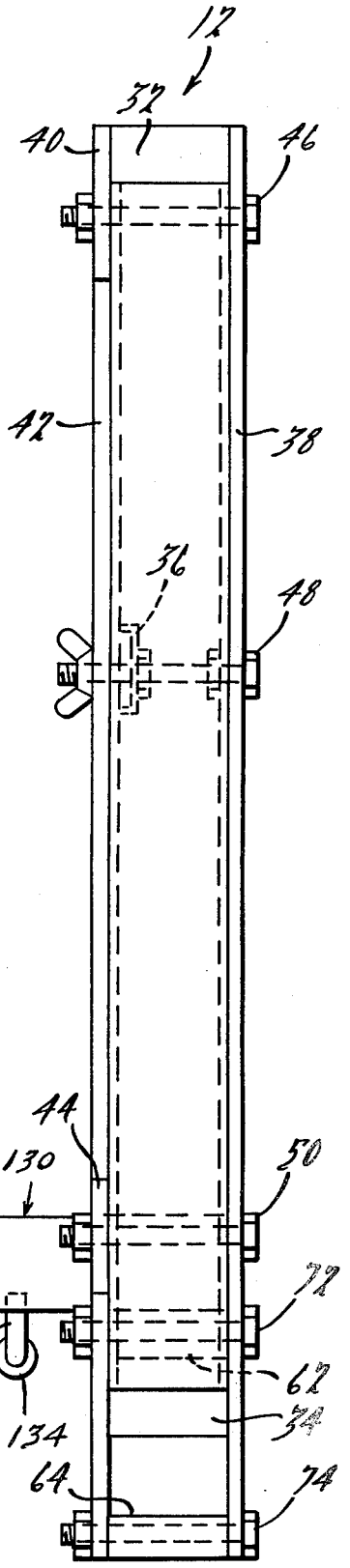
FIG. 3 is a side elevation view of the tension sensing device shown in FIG. 2.

The support structure also includes a cover plate assembly which is best seen with reference to the side elevation view of FIG. 3. The cover plate assembly comprises a back section 38 covering the entire back face of the tension sensing device 12, an upper front section 40, a central front section 42, and a lower front section 44. The back section is preferably welded to both the leg members 28 and 30 as well as to the upper and lower bar members 32 and 34. The front sections 40, 42 and 44 are preferably fastened to the leg members 28 and 30 by a plurality of bolts, such as the bolts 45, 48 and 50. The welding of the back section provides added structural integrity to the tension sensing device 12, while the fastening of the front sections provides the necessary means for accessing the interior of the device. It is also preferred that the central front section 42 be constructed from a transparent material, such as polycarbonate, i.e., Lexan, plexiglass or the like, so that a visual indication of the tension on the hoist cable 24 may be provided. The lower front section 44 of the cover plate assembly is deleted from the view of FIG. 2, so that the adjustable securing means of the support structure 26 may be shown. However, the preferred shape of the lower front section 44 is illustrated in FIG. 1.

The adjustable securing means of the support structure 26 includes a generally horizontally disposed bolt 52 for fastening the tensioning sensing device 12 to the scaffold structure 10, a tubular sleeve 54 through which the bolt is coaxially disposed, and a plurality of bearing members 56, 58 and 60 disposed along the tubular sleeve. The adjustable securing means also includes a pair of securing bar members 62 and 64 disposed such that the tubular sleeve 54 is interposed between them, a pair of adjusting screws 66 and 68 rotatably mounted in the securing bar member 64, and a pivot bolt 70 fastened to the securing bar member 62. The securing bar members 62 and 64 are fastened between the back section 38 and the lower front section 44 of the cover plate assembly by a plurality of bolts 72 and 74. The adjusting screws 66 and 68 are adapted to engage the bearing members 56 and 60, respectively, and the pivot bolt 70 is adapted to engage the bearing member 58. The bearing members 56, 58 and 60 each comprise an inner raceway fixed to the tubular sleeve 54, an outer raceway fixed to their respective adjusting screws and pivot bolt, and a plurality of anti-friction elements interposed between the inner and outer raceways. Accordingly, the bearing members permit the tension sensing device 12 to pivot about the bolt 52, so that the device may conform or automatically adjust to the vertical attitude of the hoist cable 24 along one axis. The adjusting screws 66 and 68 permit a limited pivotal movement of the tension sensing device 12 about the pivot bolt 70, so that the vertical attitude of the device may be adjusted along another axis.

The support structure 26 further includes guide means for directing the hoist cable 24 through the tension sensing device 12. The guide means includes a top aperture 72 formed in the upper bar member 32 and a top sheave 74 rotatably mounted between the back section 38 and the top front section 40 of the cover plate assembly for directing the hoist cable 24 into the tension sensing device 12. The guide means also includes a bottom aperture 76 formed in the lower bar member 34 and a bottom sheave 78 rotatably mounted between the back section 38 of the cover plate assembly and a brace member 80 for directing the hoist cable 24 out through the tension sensing device 12. The brace member 80 is preferably welded or otherwise secured to the leg member 30 and the lower bar member 34.

The tension sensing device 12 additionally includes lever arm means for sensing the tension on the hoist cable 24, and switch means for detecting the less than normal tension and strained cable conditions in response to the movement of the lever arm means. The lever arm means includes a generally vertically disposed lever arm member 82 pivotally mounted to the support structure 26 at a bolt 84 fastened to the bracket member 36, for pivotal movement in response to a variation in the tension of the hoist cable 24. The lever arm means also includes a sheave 86 rotatably mounted to the lever arm member 82 at a bolt 88, and spring means for biasing the sheave into engagement with the hoist cable 24. The lever arm means additionally includes a U-shaped retainer member 90 welded or otherwise secured to the lever arm member 82 for maintaining the hoist cable 24 in a groove of the sheave 86. The spring means comprises a guide rod member 92 fastened or otherwise secured to the lever arm member 82 at one end and slidably mounted to an angle-shaped bracket 94 of the support structure 26 at the other end, and a coil spring member 96 coaxially disposed around the guide rod member. The coil spring member 96 abuts a surface 98 of the lever arm member 82 at one end and a surface 100 of the bracket member 94 at the other end. A suitable aperture is provided in the lower end of the arm member 82 through which the adjacent end of the rod 92 projects so that the lower end of the arm 82 may pivot in the direction of an arrow 102. The force provided by the coil spring member 92 must be such as to prevent the lever arm member 82 from contacting the switch means during normal tension variations on the hoist cable 24.

The switch means comprises a first limit switch 104 for detecting the under-tensioned cable condition in response to a first predetermined pivotal movement of the lever arm member 82 in the direction of an arrow 106, and a second limit switch 108 for detecting the over-tensioned cable condition in response to a second predetermined pivotal movement of the lever arm member in the direction of the arrow 102. The limit switches 104 and 108 are fastened or otherwise secured to the back section 38 of the cover plate assembly, and are of a conventional construction. Accordingly, the limit switch may be provided with either normallyclosed or normally-opened contact states, as may be compatible with the safety circuitry associated with the hoist mechanisms 18.

The lever arm member 82 is also provided with a first finger member 110 extending generally from an upper portion thereof for cooperating with the first limit switch 104, and a second finger member 112 extending generally from a lower portion thereof for cooperating with the second limit switch 108. The relative lengths of the finger members 110 and 112 define the limits of the pivotal movement for the lever arm member 82. In a preferred form of the present invention, the finger members 110 and 112 comprise bolts which are adjustably mounted in the lever arm member 82 so that the first and second predetermined pivotal movements may be varied in accordance with type or rating of the hoist cable 24 employed.

In operation, the variation in the tension on the hoist cable 24 will cause the lever arm member 82 to pivot. When the tension on the hoist cable 24 decreases the lever arm member 82 will pivot in the direction of the arrow 106, causing the first finger member 110 to swing toward the first limit switch 104. As the tension on the hoist cable 24 further decreases to create an abnormal slack, the lever arm member 82 will pivot to the extent of the first predetermined pivotal movement, thereby causing the first finger member 110 to contact the first limit switch 104 and alter the contact state of this switch. When the tension on the hoist cable 24 increases, the lever arm member 82 will pivot in the direction of the arrow 102, causing the second finger member 112 to swing toward the second limit switch 108. As the tension on the hoist cable 24 further increases to create an abnormal strain, the lever arm member 82 will pivot to the extent of the second predetermined pivotal movement, thereby causing the second finger member 112 to contact the second limit switch 108 and alter the contact state of this switch.

The tension sensing device 12 also includes an upwardly biased rod member 114 slidably mounted to an angle shaped bracket 116 of the support structure 26, and a third limit switch 118 for detecting an upper limit condition in response to a predetermined downward translational movement of the rod member. A portion of the rod member 114 extends above the support structure 26 to engage any projection which may be intentionally or inadvertently positioned above the scaffold structure 10. Accordingly, the combination of the rod member 114 and the third limit switch 118 provide an additional safety measure which prevents the hoist mechanisms 18 from attempting to raise the scaffold structure 10 beyond a preselected upper limit or against a fixed projection. The tension sensing device 12 further includes a bypass switch 120 mounted to the back section 38 of the cover plate assembly. The bypass switch may be used in the appropriate circumstances to disconnect the limit switches 104, 108 and 118 from the safety circuitry of the hoist mechanisms 18. A suitable aperture (not shown) is also included in the leg member 28 of the support structure 26, so that a conduit 122 carrying the electrical wires leading to the above-identified switches may access the interior of the tension sensing device 12.

In accordance with another feature of the present invention, the tension sensing device 12 may be provided with suitable controls, as indicated at 130 in FIGS. 1–3 for sensing the degree of unlevelness of the associated scaffold structure. Such sensing means may be of any one of a number of alternate designs and is shown, by way of example herein as comprising an actuating arm 132 having an engagement element 134 that is intended to contact an associated structural member to provide an indication, either electrical, mechanical, etc., of the degree of out-of-levelness of the scaffold structure 10. It is to be noted that such an out-of-level sensing device or control as well as the various other controls provided by the device 12 are all located or grouped together in a central location in such a fashion that they can be easily observed, which is a particularly important feature not shown in prior known arrangements.

It will be appreciated that the above disclosed embodiment is well calculated to achieve the aforementioned objects of the present invention. In addition, it is evident that those skilled in the art, once given the benefit of the foregoing disclosure, may now make modifications of the specific embodiment described herein without departing from the spirit of the present invention. Such modifications are to be considered within the scope of the present invention which is limited solely by the scope and spirit of the appended claims.

What is claimed is:

1. In a scaffold suspended by at least one hoist cable, a tension sensing device for detecting an under or over-tensioned cable condition, comprising:

a support structure adapted to be secured to said scaffold and having guide means for directing said hoist cable through said device;

lever arm means for sensing the tension on said hoist cable, including a generally vertically disposed lever arm member pivotally mounted to said support structure for pivotal movement in response to a variation in the tension of said hoist cable, a sheave rotatably mounted to said lever arm member, and spring means for biasing said sheave into engagement with said hoist cable; and switch means for detecting said under-tensioned cable condition in response to a first predetermined pivotal movement of said lever arm member and for detecting said over-tensioned cable condition in response to a second predetermined pivotal movement of said lever arm member in the opposite direction of said first predetermined pivotal movement.

2. The tension sensing device according to claim 1, wherein said switch means comprises a first limit switch for detecting said under-tensioned cable condition and a second limit switch for detecting said over-tensioned cable condition.

3. The tension sensing device according to claim 2 wherein said lever arm means further includes a first finger member extending generally from an upper portion of said lever arm member for cooperating with said first limit switch, and a second finger member extending generally from a lower portion of said lever arm member for cooperating with said second limit switch.

4. The tension sensing device according to claim 3 wherein said first predetermined pivotal movement of said lever arm member causes said first finger member to contact said first limit switch and alter the state of said first limit switch.

5. The tension sensing device according to claim 4 wherein said second predetermined pivotal movement of said lever arm member causes said second finger member to contact said second limit switch and alter the state of said second limit switch.

6. The tension sensing device according to claim 5 wherein the length of said first and second finger members are adjustable.

7. The tension sensing device according to claim 5 wherein said support structure includes a cover plate assembly with at least said cover plate assembly being constructed from a transparent material so that the tension on said hoist cable may be visually observed.

8. The tension sensing device according to claim 7 wherein said guide means includes a top aperture formed in said support structure and a top sheave rotatably mounted to said cover plate assembly for directing said hoist cable into said device, and a bottom aperture formed in said support structure and a bottom sheave rotatably mounted to at least one section of said cover plate assembly for directing said hoist cable out through said device.

9. The tension sensing device according to claim 8 wherein said device further includes an upwardly biased rod member slidably mounted to said support structure and having a portion extending above said support structure, and a third limit switch for detecting an upper limit condition in response to a predetermined downward translational movement of said rod member.

10. The tension sensing device according to claim 9 wherein said first, second and third limit switches are mounted to one section of said cover plate assembly.

11. The tension sensing device according to claim 8 wherein said support structure includes adjustable securing means for permitting the adjustment of the vertical attitude of said device with respect to said scaffold along two axes.

12. The tension sensing device according to claim 11 wherein said adjustable securing means includes a generally horizontally disposed bolt for fastening said device to said scaffold, a tubular sleeve through which said bolt is coaxially disposed, a plurality of bearing members disposed along said tubular sleeve for permitting the adjustment of the vertical attitude of said device along one axis, and a plurality of adjustment screws rotatably mounted in said support structure and engaging said bearing members for permitting the adjustment of the vertical attitude of said device along another axis.

13. The tension sensing device according to claim 1 which includes sensing means for sensing the degree of unlevelness of the associated scaffold structure.

* * * * *